US006612946B1

(12) United States Patent
McClain

(10) Patent No.: US 6,612,946 B1
(45) Date of Patent: Sep. 2, 2003

(54) GAME BALL ANTI-THEFT DEVICE

(76) Inventor: Fred McClain, 37422 17th St. E., Palmdale, CA (US) 93550

( * ) Notice: Subject to any disclaimer, the term of this patent is extended or adjusted under 35 U.S.C. 154(b) by 0 days.

(21) Appl. No.: 10/291,478

(22) Filed: Nov. 8, 2002

Related U.S. Application Data

(63) Continuation of application No. 09/735,042, filed on Dec. 13, 2000, now abandoned.

(51) Int. Cl.[7] ..... A63B 47/00

(52) U.S. Cl. ..... 473/569; 473/575; 206/315.9; 224/919

(58) Field of Search ..... 473/423, 424, 473/426, 430, 569, 575, 576; 206/315.9, 315.91; 224/919, 315; 294/152, 156, 157, 165

(56) References Cited

U.S. PATENT DOCUMENTS

| | | | | | |
|---|---|---|---|---|---|
| 2,532,306 | A | * | 12/1950 | Herbert | 294/165 |
| 3,351,343 | A | * | 11/1967 | Papp | 473/430 |
| 3,918,618 | A | * | 11/1975 | Castaneda | 294/157 |
| 4,063,637 | A | * | 12/1977 | Danforth | 224/413 |
| 4,147,353 | A | * | 4/1979 | Moore | 473/575 |
| 4,247,117 | A | * | 1/1981 | Reichert | 473/424 |
| 4,305,584 | A | * | 12/1981 | Leehan | 224/919 |
| 4,510,982 | A | * | 4/1985 | Sangroni | 224/919 |
| 5,232,101 | A | * | 8/1993 | Shaftner et al. | 211/14 |
| 5,586,760 | A | * | 12/1996 | Hauter | 473/424 |
| 5,775,559 | A | * | 7/1998 | Mechanic et al. | 224/919 |

* cited by examiner

*Primary Examiner*—Steven Wong
(74) *Attorney, Agent, or Firm*—Goldstein & Lavas, P.C.

(57) ABSTRACT

A game ball anti-theft device including a spherical web dimensioned for completely enclosing the game ball therein. The spherical web is comprised of a plurality of cables.

4 Claims, 2 Drawing Sheets

GAME BALL ANTI-THEFT DEVICE

CROSS REFERENCES AND RELATED SUBJECT MATTER

This application is a continuation of patent application Ser. No. 09/735,042, filed in the U.S. Patent office on Dec. 13, 2000, now abandoned.

BACKGROUND OF THE INVENTION

The present invention relates to a game ball anti-theft device and more particularly pertains to preventing a game ball from being removed from a public area.

When people go to public places to participate in a sporting contest, they are usually forced to bring a game ball with them. This is particularly the case when playing pick-up basketball in a part of other outdoor setting. Sometimes younger players travel to the park on their bicycle, making the transport of a basketball a difficult task. Sometimes, these players will choose to leave their ball behind for use on the next day instead of having to lug the ball home on their bicycle. This is a risky proposition due to the potential for theft. What is needed is a way to leave a basketball or other game ball at an outdoor venue without the risk of the ball being stolen or lost.

The present invention attempts to solve the abovementioned problem by providing a webbing type enclosure that will surround the game ball and can be locked around the ball and a nearby fence or other permanent structure.

The use of receptacles suited for containing sports balls is known in the prior art. More specifically, receptacles suited for containing sports balls heretofore devised and utilized for the purpose of holding sports balls for transport are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,207,360 to Stine discloses a ball bag comprised of webbings and straps capable of being attached to the handlebars of a bicycle. U.S. Pat. No. 4,502,576 to Reardon discloses a portable locker device for sports equipment. U.S. Pat. No. 5,085,320 to Scott discloses a bag for carrying a game ball.

U.S. Pat. No. 4,247,117 to Reichert and U.S. Pat. No. 4,147,353 to Moore both disclose devices which encapsulate a game ball so that it can be tether to a person or a spike, respectively for training purposes and for retrieval of the ball. However, these devices not adequately secure the ball so as to prevent its theft.

While these devices fulfill their respective, particular objective and requirements, the aforementioned patents do not describe a game ball anti-theft device for preventing a game ball from being removed from a public area.

In this respect, the game ball anti-theft device according to the present invention substantially departs from the conventional concepts and designs of the prior art, and in doing so provides an apparatus primarily developed for the purpose of for preventing a game ball from being removed from a public area.

Therefore, it can be appreciated that there exists a continuing need for a new and improved game ball anti-theft device which can be used for preventing a game ball from being removed from a public area. In this regard, the present invention substantially fulfills this need.

SUMMARY OF THE INVENTION

In the view of the foregoing disadvantages inherent in the known types of receptacles suited for containing sports balls now present in the prior art, the present invention provides an improved game ball anti-theft device. As such, the general purpose of the present invention, which will be described subsequently in greater detail, is to provide a new and improved game ball anti-theft device which has all the advantages of the prior art and none of the disadvantages.

To attain this, the present invention essentially comprises a spherical web dimensioned for completely enclosing the game ball therein. The spherical web is comprised of a plurality of cables. The plurality of cables includes three fixed lateral rings disposed in a spaced relationship. The plurality of cables include two openable longitudinal rings. Each of the longitudinal rings has opposed free ends. The free ends have hoops disposed thereon. The hoops are alignable in a closed orientation for receiving a padlock.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved game ball anti-theft device which has all the advantages of the prior art receptacles suited for containing sports ball and none of the disadvantages.

It is another object of the present invention to provide a new and improved game ball anti-theft device which may be easily and efficiently manufactured and marketed.

It is a further object of the present invention to provide a new and improved game ball anti-theft device which is of durable and reliable construction.

An even further object of the present invention is to provide a new and improved game ball anti-theft device which is susceptible of a low cost of manufacture with regard to both materials and labor, and which accordingly is then susceptible of low prices of sale to the consuming public, thereby making such NEW economically available to the buying public.

Even still another object of the present invention is to provide a new and improved game ball anti-theft device for preventing a game ball from being removed from a public area.

Lastly, it is an object of the present invention to provide a new and improved game ball anti-theft device including a spherical web dimensioned for completely enclosing the game ball therein. The spherical web is comprised of a plurality of cables.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
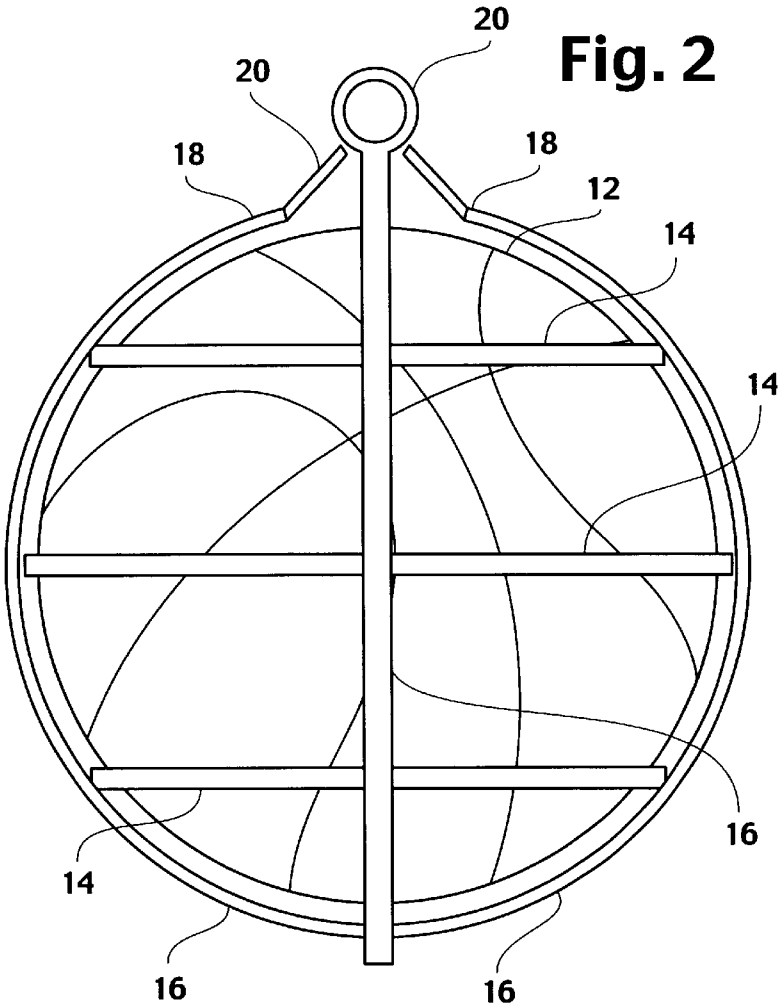
FIG. 2 is a side view of the present invention with a game ball positioned therein.
Figure 1:
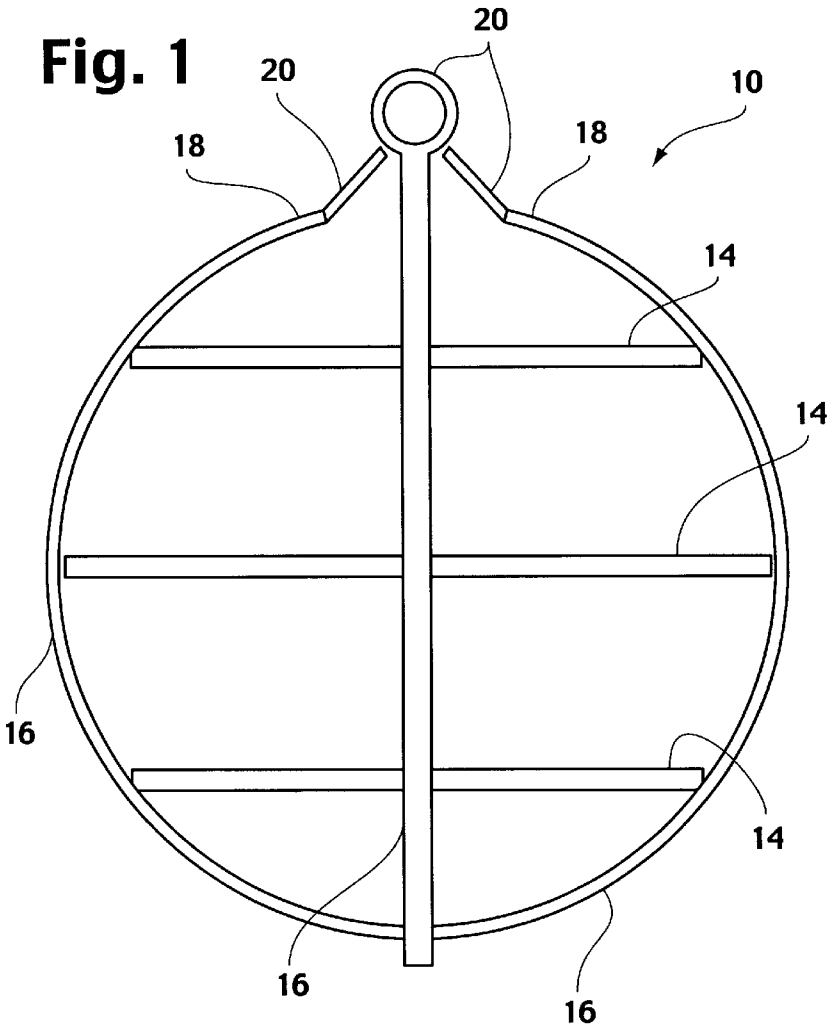
FIG. 1 is a perspective view of the preferred embodiment of the game ball anti-theft device constructed in accordance with the principles of the present invention.
Figure 3:
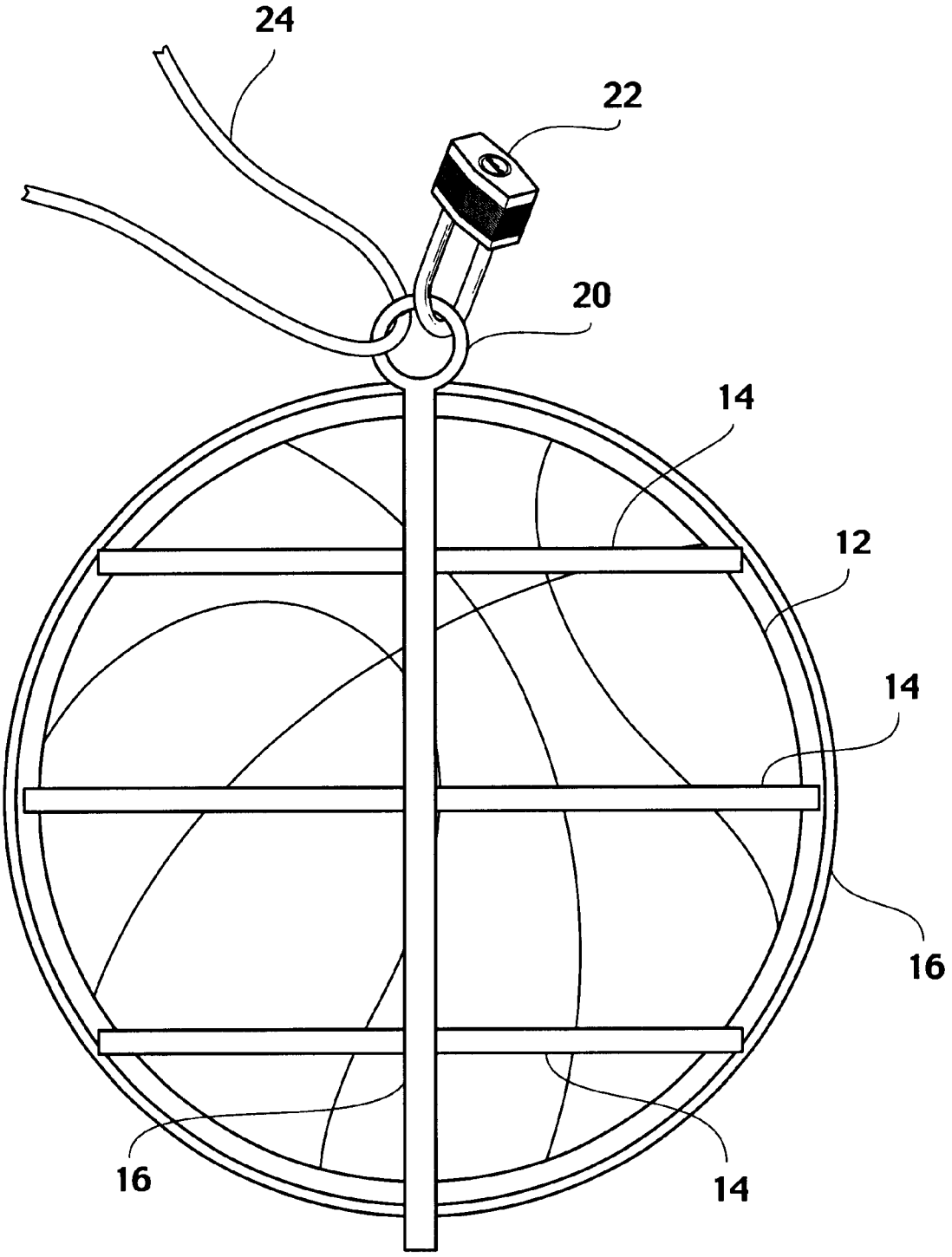
FIG. 3 is a side view of the present invention illustrated in use.

With reference now to the drawings, and in particular, to FIGS. 1 through 3 thereof, the preferred embodiment of the new and improved game ball anti-theft device embodying the principles and concepts of the present invention and generally designated by the reference number 10 will be described.

Specifically, it will be noted in the various Figures that the device relates to a game ball anti-theft device for preventing a game ball from being removed from a public area.

The present invention is essentially comprised of a spherical web 10. Note FIG. 1. The spherical web 10 is dimensioned for completely enclosing the game ball 12 therein. Note FIGS. 2 and 3. The spherical web 10 is comprised of a plurality of cables. The cables used should be pliable, yet resistant to theft. The plurality of cables includes three fixed lateral rings 14 disposed in a spaced relationship. The plurality of cables include two openable longitudinal rings 16. Each of the longitudinal rings 16 has opposed free ends 18. The free ends 18 have hoops 20 disposed thereon. The hoops 20 are alignable in a closed orientation for receiving a padlock 22. Note FIG. 3. In muse, the spherical web 10 is opened by separating the free ends 18 of the openable longitudinal rings 16 to create an opening that is large enough to receive the game ball 12 therein. Once the game ball 12 is positioned within the spherical web 10, the free ends 18 of the longitudinal rings 16 are closed whereby the hoops 20 are aligned. The spherical web 10 and the game ball 12 are then positioned adjacent to a fence area or secure tether 24 with the padlock 22 engaging the aligned hoops 20 and the fence or tether 24 so as to safely secure the game ball 12 to the fence or tether 24 whereby theft of the game ball is prevented.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A game ball anti-theft device for preventing a game ball from being removed from a public area by attaching the game ball to a secure tether in the public area, comprising, in combination:

a spherical web dimensioned for completely enclosing the game ball therein, the spherical web being comprised of a plurality of cables, the plurality of cables including three fixed lateral rings disposed in a spaced relationship, the plurality of cables including two openable longitudinal rings to create an opening large enough to allow the game ball to be inserted within the spherical web, each of the longitudinal rings having opposed free ends, the free ends having hoops disposed thereon, the hoops being alignable in a closed orientation; and a padlock for securing the hoops together and attaching the hoops to the secure tether.

2. A game ball anti-theft device for preventing a game ball from being removed from a public area having a secure tether, comprising, in combination:

a spherical web dimensioned for completely enclosing the game ball therein, the spherical web being comprised of a plurality of cables defining a pair of longitudinal rings, each having two free ends having two hoops, the spherical web creates an opening for allowing the game ball to be inserted within the spherical web when the hoops are separated; and a padlock for securing the hoops together and attaching the hoops to the secure tether.

3. The game ball anti-theft device as set forth in claim 2, wherein the plurality of cables include at least one fixed lateral ring.

4. The game ball anti-theft device as set forth in claim 2, wherein the plurality of cables includes three fixed lateral rings disposed in a spaced relationship.

* * * * *